US005813143A

United States Patent [19]

Bell et al.

[11] Patent Number: 5,813,143

[45] Date of Patent: Sep. 29, 1998

[54] CONVERTIBLE NON-SLIP FOOTWEAR ATTACHMENT DEVICE HAVING ICE/SNOW ENGAGING CLEATS

[75] Inventors: Michael Bell, 1705 Triumphe Way, Warrington, Pa. 18976; Jonathan Bell, Philadelphia, Pa.

[73] Assignee: Michael Bell, Warrington, Pa.

[21] Appl. No.: 769,474

[22] Filed: Dec. 20, 1996

[51] Int. Cl.[6] ..... A43B 23/28; A43B 3/16; A43B 3/10

[52] U.S. Cl. ..... 36/59 R; 36/7.11; 36/7.6

[58] Field of Search ..... 36/7.1 R, 7.5, 36/7.6, 7.7, 62, 67 D, 59 R, 11.5, 4, 7.3, 7.4, 122, 123, 125, 138, 132, 67 R

[56] References Cited

U.S. PATENT DOCUMENTS

| | | | |
|---|---|---|---|
| 1,195,866 | 8/1916 | Stephan | 36/7.6 |
| 1,547,568 | 7/1925 | Easton | 36/62 |
| 2,189,489 | 2/1940 | Fritz | 36/7.6 |
| 2,932,096 | 4/1960 | Tavormina | 36/7.6 X |
| 3,355,823 | 12/1967 | Vogt | 36/7.6 |
| 4,562,834 | 1/1986 | Bates et al. | 36/7.1 R X |
| 4,967,491 | 11/1990 | Plotkin | 36/7.1 R |
| 5,396,717 | 3/1995 | Bell | 36/7.3 |

FOREIGN PATENT DOCUMENTS

| | | | |
|---|---|---|---|
| 78913 | 5/1983 | European Pat. Off. | 36/62 |

*Primary Examiner*—B. Dayoan
*Attorney, Agent, or Firm*—Caesar, Rivise, Bernstein, Cohen & Pokotilow, Ltd.

[57] ABSTRACT

An convertible, footwear attachment device and methods of configuring it and using it on a primary footwear to provide resistance to slippage on snow, ice or other slick surfaces. The attachment device is of the sling-type, full-sole unit and is formed of an elastic, flexible and severable material. The full-sole unit is made up of a sole, a toe attachment assembly, a heel attachment assembly, and visible indicia, e.g., grooves, for indicating the boundaries of a removable portion of the full-sole unit which may be severed therefrom to form the half-sole unit. The attachment assemblies enable the device to be releasably mounted on the primary footwear irrespective of whether the device is converted from the full-sole unit to the half-sole unit or not. The sole and heel portions of the full-sole unit each include plural hard, ice-gripping projections, e.g., spikes.

11 Claims, 4 Drawing Sheets

FIG.2
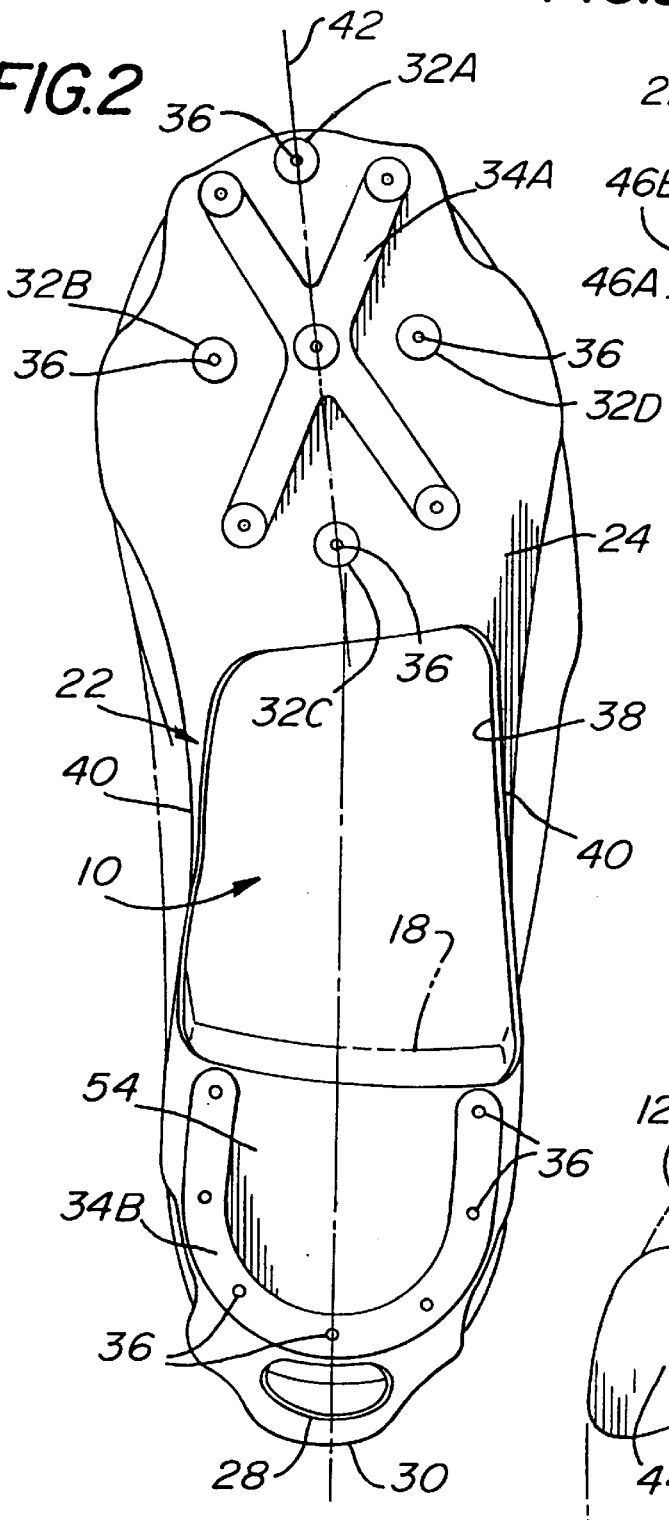
FIG.3
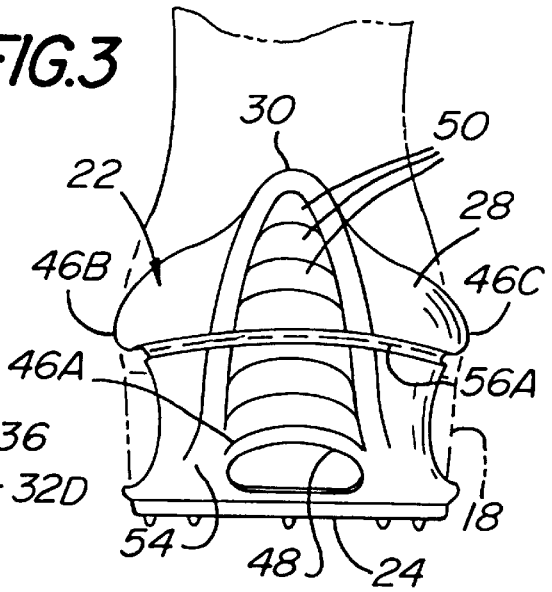
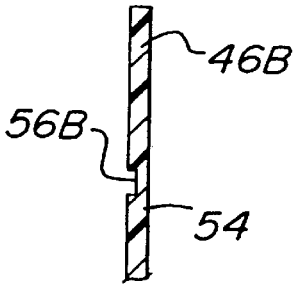
FIG.5
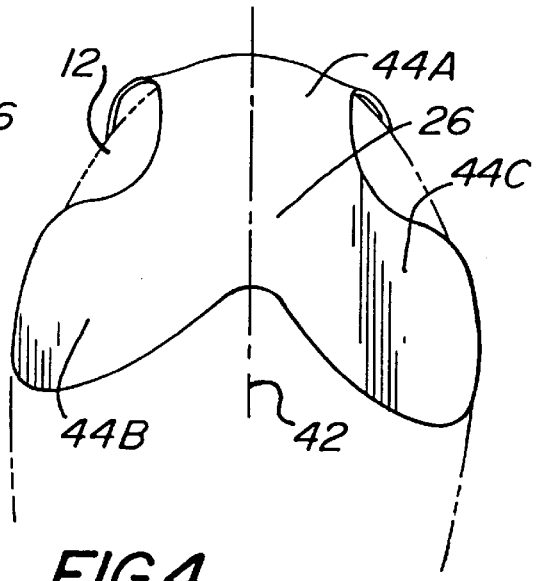
FIG.4

CONVERTIBLE NON-SLIP FOOTWEAR ATTACHMENT DEVICE HAVING ICE/SNOW ENGAGING CLEATS

BACKGROUND OF THE INVENTION

This invention relates generally to footwear, and more particularly to footwear attachments adapted to be worn over primary footwear, e.g., boots, shoes, etc., to provide resistance to slipping in icy or snowy conditions.

Various sling-type, anti-slip attachment devices have been and are commercially available for mounting on a boot or shoe, to provide resistance to slippage on ice or snow or other slick surfaces. Such devices can be classified in two basic varieties or types, the "full sole" and the "half sole" types. The full sole sling-type device is typically molded as a one-piece unit of a stretchable material, e.g., rubber, and includes a sole portion extending under both the forefoot and heel regions of the primary footwear and with toe straps or loops and heel counter straps or loops for disposition on respective portions of the upper of the primary footwear to hold the device in place. The sole may or may not include an arch portion. In any case spikes or cleats of metal or some other hard material are typically provided projecting downward from portions of the device's sole in the toe/forefoot region and in the heel region. The full sole attachment device offers significant protection from slippage, due to the use of the ice/snow engaging spikes in both the toe/forefoot and heel regions of the device.

The half sole footwear attachment device is similar to the full sole type, except that it doesn't include any sole portion at the location of the heel of the primary footwear. Instead the portion of the half sole device which is located in the heel region of the primary footwear includes an opening or hole through which the heel of the primary footwear extends when the device is in place thereon.

While the half sole, non-slip, sling-type, attachment device may not provide as much resistance to slippage as the full sole type in some applications, it never the less offers certain advantages over the full sole type device in other applications. For example, if the device is to be worn while driving a vehicle, the use of the half sole type is preferable in order to ensure that there are no hard spikes or cleats are located in the heel region, since they could either damage the vehicle's floor or present a snagging hazard when the vehicle is being driven. Also, if it is necessary for the wearer of the device to stand on a clean flat indoor or outdoor floor or surface for an extended period of time, the use of the half sole device is preferable to minimize damage to the floor or support surface. Moreover, in some applications comfort to the wearer is best achieved with the half sole type. In this regard in some industries, e.g., the railroad industry, certain job functions require individuals to work in slippery conditions, but also to ride in rail cars. This is often done by the worker standing on his/her heels on the edge of the rail car while the worker's forefoot/toe hangs off of the edge of the car. Thus, all of the worker's weight is borne by his/her heels. Use of the full sole sling type attachment device with spikes in the heel region, may tend to exacerbate the pressure concentration at the worker's heel, leading to discomfort. Thus, for such applications the half sole device may be preferred. The half sole type device is also desirable from the standpoint of being better suited for accommodating various size and shapes of primary footwear, owing to the large heel-receiving opening extending from the forefoot region to the end of the heel region. Thus, the same half sole device can be used to accommodate a wide heeled boot, such as a "sorel" type work boot, yet also accommodate a narrow heeled shoe, such as a woman's pump.

Since various factors, such as those described above, may militate the use of one type of device over the other, in the interest of economics it is desirable to provide a sling-type, slip-resistant attachment which can be readily configured for use in any conditions requiring either the full sole type or the half sole type and to accommodate primary footwear of various sizes and shapes with the same sling-type device. Heretofore such an adaptable sling-type attachment device has not been proposed or available. Thus, a need exists for a non-slip attachment which can be readily converted from the full sole type to the half sole type for any of the foregoing reasons.

The subject invention addresses that need, and basically comprises an attachment for a boot, shoe or any other type of primary footwear to provide enhance slip-resistance therefore. The primary footwear has a sole and an upper secured to the sole. The upper has a toe portion and a heel counter portion. The sole has a toe portion, a contiguous forefoot portion, an arch portion, and a contiguous heel portion.

The attachment device is formed of a severable material, e.g., rubber or resilient PVC, and comprises a sole, toe attachment means, heel attachment means, and visible indicia. The visible indicia is provided for indicating the boundaries of a removable portion of the attachment device which may be severed from the remainder of the attachment device, if desired. The sole of the attachment device has a toe portion, a contiguous forefoot portion, and a heel portion. The toe attachment means, e.g., three straps which merge together, projects from the toe/forefoot portion of the attachment device to form a toe box adapted to receive the toe portion of the primary footwear for releasably securing the attachment thereto. The heel attachment means, e.g., three straps which merge together, projects from the heel portion of the attachment device to form a heel-counter receptacle adapted to receive the heel of the primary footwear's sole and the heel counter of its upper for releasably securing the attachment device thereto.

The sole and heel portions of the attachment device each include plural hard, ice-gripping projections, e.g., spikes or cleats. The heel portion of the attachment device also includes the aforementioned indicia. That indicia enables the attachment device to be converted from a full sole type to a half sole type. In particular, the removable portion of the sole of the attachment device can be severed from the remainder of the attachment device along the indicia to produce an opening through which the heel of the primary footwear may be extended when the attachment device is in place. If the attachment device is desired to be a full sole type, the removable portion of the device is left intact, i.e., is not removed.

DESCRIPTION OF THE DRAWINGS

Other objects and many attendant features of this invention will become readily appreciated as the same becomes better understood by reference to the following detailed description when considered in connection with the accompanying drawings wherein:

FIG. 2 is a plan view of the bottom of the full-sole configured device shown in FIG. 1;

FIG. 3 is a rear elevational view of the full-sole configured device shown in FIG. 1;

FIG. 4 is a top plan view of a portion of the full-sole configured device shown in FIG. 1;

FIG. 5 is an enlarged sectional view taken along line 5—5 of FIG. 1;

DETAILED DESCRIPTION OF THE PREFERRED EMBODIMENTS

Figure 1:
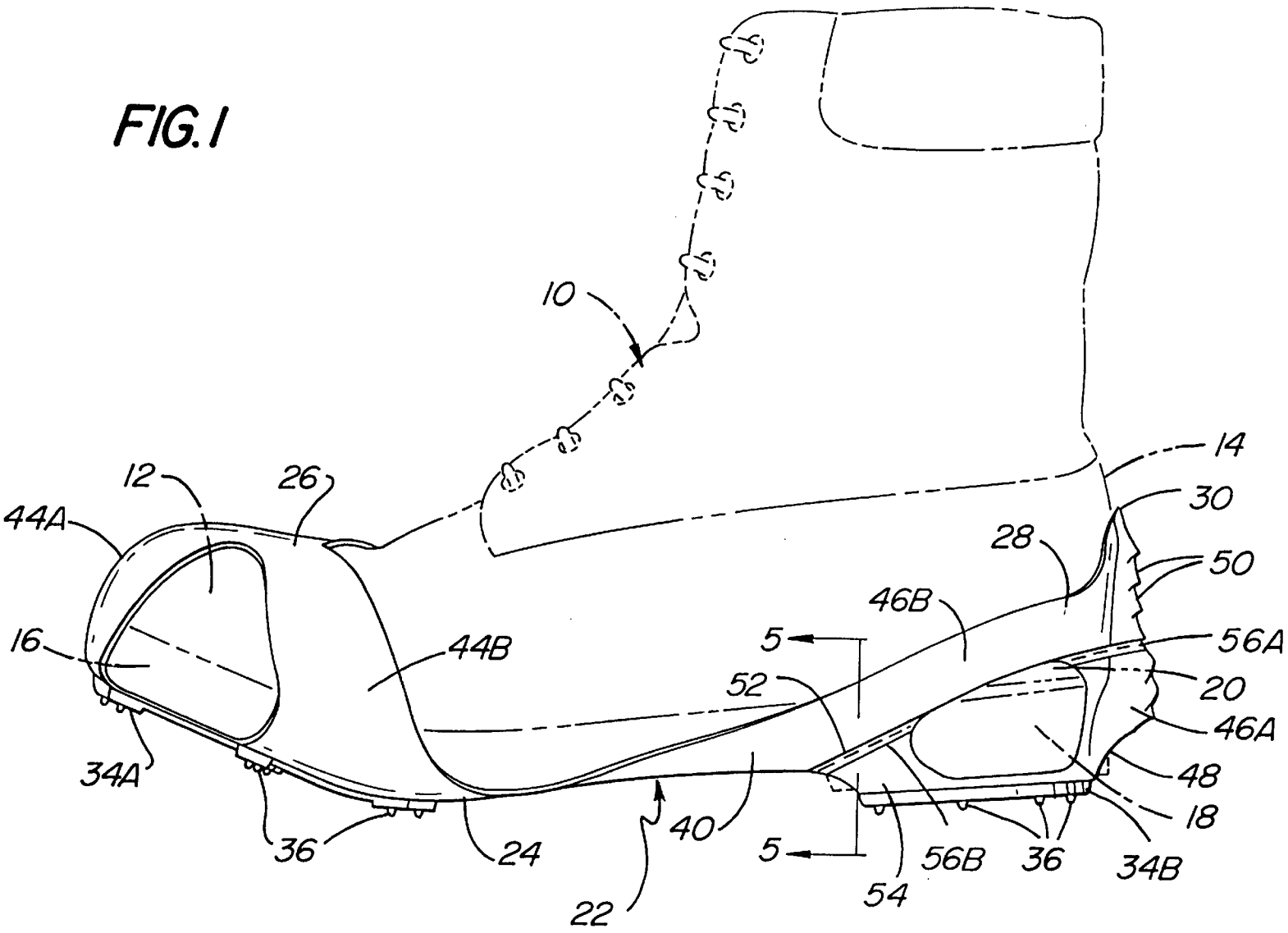
FIG. 1 is a side elevational view of the convertible slip-resistant attachment device of this invention shown in place on a typical primary footwear, e.g., a boot, shown in phantom lines, and with the device being configured in its "full-sole" configuration.

Referring now to various figures of the drawing where like reference numerals refer to like parts there is shown at 20 in FIG. 1, a convertible slip-resistant, attachment device for use on a primary footwear, and which device is constructed in accordance with this invention. The convertible device 20 is arranged to be used, i.e., worn, on a shoe or boot 10 or any other primary footwear to render it resistant to slippage on ice or snow or other slick surfaces. The boot 10 is shown in phantom in drawings herein, is of conventional construction, and is merely exemplary of any type of primary footwear on which the subject invention can be worn. The boot 10 basically comprises an upper having a toe portion 12 and a heel counter portion 14. The upper is mounted on a sole assembly having a toe/forefoot/arch portion 16 and a heel portion 18.

The device 20 is preferably an integral or one-piece, sling-type, unit molded from any suitable flexible, resilient material, e.g., rubber or polyvinyl chloride. By virtue of the flexible, resilient nature of the material making up the unit 20, it can be stretched to accommodate various sizes and shapes of primary footwear. The unit 20 basically comprises a sole 24, a toe box 26, a heel counter box 28, a pull tab 30. The details of the toe box and heel counter box will be described later. Suffice it for now to state that the toe box is made up of plural straps which extend from respective portions of the sole 24 and merge together above the sole so as to form a hollow interior space into which the toe portion 12 of the upper of the boot 10 can fit to releasably mount the front of the unit 20 thereon. The heel counter box is also made up of plural straps which extend from respective portions of the sole 24 and merge together above the sole so as to form a hollow interior space into which the heel portion 18 of the sole of the boot 10 the contiguous heel counter portion 14 of the upper of the boot can fit to releasably mount the rear of the unit 20 thereon.

As should be appreciated by those skilled in the art the flexible, resilient nature of the material making up the unit 20 enables the straps of the toe box and the heel counter box to stretch to accommodate footwear of various sizes and shapes.

As can best be seen in FIG. 2, the sole 24 includes plural raised circular cleats 32A–32D and plural raised ridges 34A and 34B. Steel or other hard material spikes 36 are mounted in the cleats and ridges to project outward therefrom. The spikes 36 are arranged to dig into ice, snow or other slick surfaces when the attachment unit 20 is worn on the boot 10 or any other primary footwear, and thereby provide enhanced traction for the wearer. In particular, as can be seen the ridge 34A is of a general X-shape and is located in the underside of the sole of the unit 20 in the toe and contiguous forefoot regions. The circular cleats 32A–32D are located in the interstices of the crossing portions of the X-shaped ridge 34A. The ridge 34B is of a general U-shape and is located in the underside of the sole of the unit 20 in the heel regions. The arch region of the sole of the unit 20 is open. In particular it includes an opening 38 between the forefoot and heel regions so as to define a pair of side straps 40 on either side of the longitudinal axis 42 of the unit 20 and which connect the toe/forefoot portion of the unit to the heel portion of the unit.

As best seen in FIG. 4 the toe box 26 comprises three straps 44A, 44B, and 44C. The strap 44A projects from the tip or toe of the sole 24 and extends upward and backward therefrom. The strap 44B projects from one side of the sole in the forefoot region adjacent to the arch region and extends upward and forward therefrom at an acute angle to the longitudinal axis 42 to merge with the strap 44A at a junction. In a similar manner the strap 44C projects from the opposite side of the sole in the forefoot region adjacent to the arch region and extends upward and forward therefrom at an acute angle to the longitudinal axis 42 to also merge with the strap 44A at the junction. This arrangement thus forms a hollow interior space between the straps 44A, 44B, and 44C and the inner surface of the sole 24 of the unit 20 to accommodate the toe portion of the boot, as mentioned earlier.

As best seen in FIGS. 1 and 3 the heel counter box 28 comprises three straps. In particular, one strap 46A projects from the rearmost portion of the sole 24 and extends upward therefrom. Another strap 46B projects from one side of the sole in the heel region adjacent to the arch region and extends upward and rearward therefrom at an acute angle to the longitudinal axis 42 to merge with the strap 46A at a junction. In a similar manner a third strap (not shown) projects from the opposite side of the sole in the heel region adjacent to the arch region and extends upward and rearward therefrom at an acute angle to the longitudinal axis 42 to also merge with the strap 46A at the junction. This arrangement thus forms a hollow interior space between those straps and the inner surface of the sole 24 of the unit 20 to accommodate the heel counter portion 14 of the boot 10 as mentioned earlier. An opening 48 is provided in the strap 46A to accommodate the rear portion of the heel of the primary footwear as shown in FIGS. 1 and 3.

The pull tab 30 extends upward from the junction of the straps heel counter straps to provide a gripping portion to enable the attachment unit to be pulled onto the heel counter of the boot 22. In order to facilitate the pulling of the attachment unit onto the heel counter, plural stepped ridges 50 are located on the outer surface of the strap 46A and on the pull tab 30.

In order to enable the unit 20 to be converted to a-half-sole type device, the unit includes indicia means defining the boundary or "trim line" of a portion of the sole 24 and contiguous strap which can be removed to form a half-sole unit. The removable portion of the unit 20 is identified by the reference number 54 and basically comprises the heel portion of the sole 24 which includes the U-shaped ridge and associated spikes and the lower portion of the strap 46A. The trim line or indicia basically comprises three generally linear grooves. In particular, a first generally linear, horizontally oriented groove 56A of reduced material thickness is located in the strap 46A immediately below the junction at which the other two straps of the heel counter box merge with it. A second, and angularly oriented linear groove 56B, also of reduced thickness material, is located in the sole 26 immediately below the junction from which the strap 46B extends backward as clearly shown in FIG. 1. A similar groove (not shown) is located in the sole below the junction from which the opposite strap extends backward. These three grooves, plus the rear edge of the sole opening 38 and the lower edges of the two angled straps of the heel counter box define the boundary of the removable portion 54 of the unit. In order to remove the removable portion, a scissors or some other cutting means (not shown) can be used to sever the material making up the unit along the trim line grooves.

It should be pointed out at this juncture that the use of one or more grooves to establish the boundary or trim line of the removable portion of the unit 20 is not mandatory. Thus, any visually perceptible means, e.g., as a raised ridge, a colored line, etc., can be used to define the trim line and demarcate boundary of the portion 54 of the unit 20 which is to be severed and removed. In fact, the trim line or indicia need not even be part of the unit 20 itself. Thus, it is contemplated the indicia be in the form of written or other recorded instructions describing the portion(s) 54 of the unit 20 to be severed or removed. In such a case, all that is required for the user is to follow the written or recorded instructions and trim or remove the removable portion 54 of the unit 20.

In order to expedite the severing or removal of the removable portion of the unit, the boundary of the removable portion of the unit may be weakened, e.g., the groove perforated, so that the removable portion can be torn away without requiring a scissors or other severing device.

Figure 6:
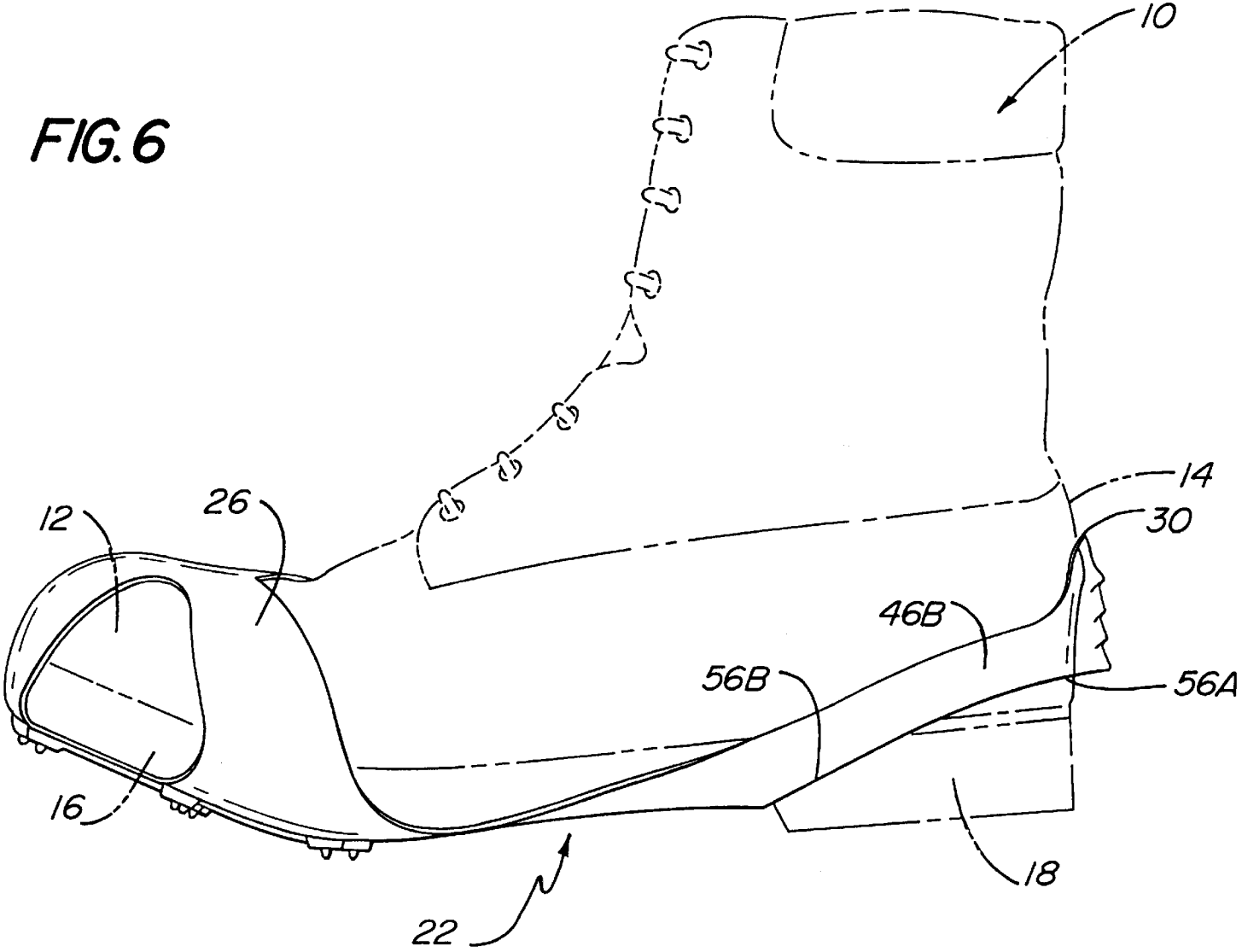
FIG. 6 is a side elevational view of the convertible slip-resistant attachment device of this invention shown in place on a typical primary footwear, e.g., a boot, shown in phantom lines, and with the device being configured in its "half-sole" configuration.
Figure 7:
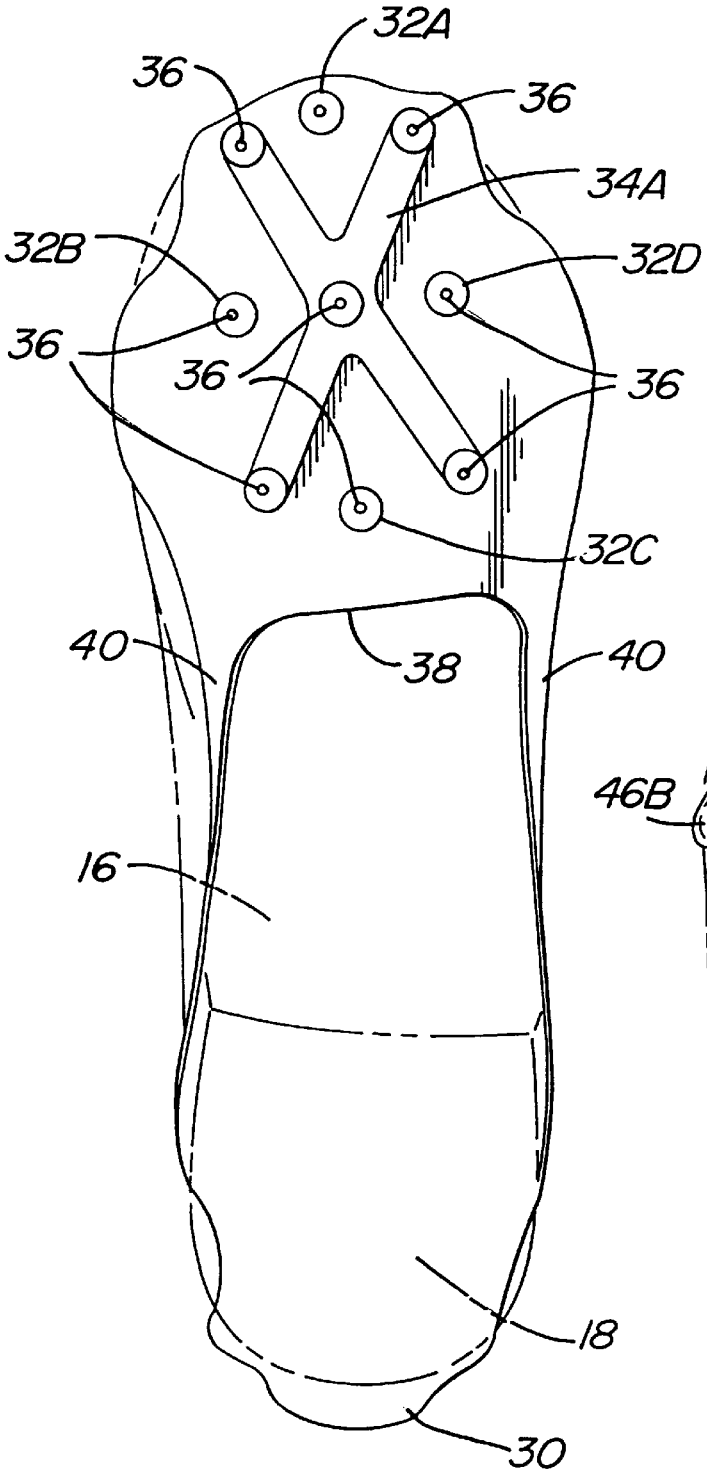
FIG. 7 is a plan view of the bottom of the half-sole configured device shown in FIG. 6.
Figure 8:
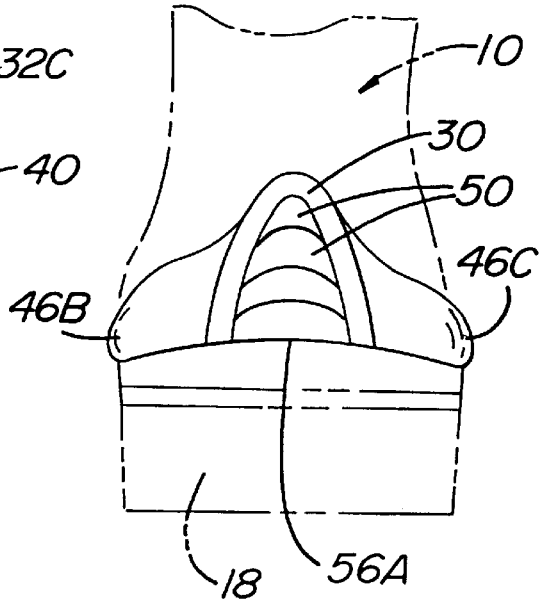
FIG. 8 is a rear elevational view of the half-sole configured device shown in FIG. 6.

In any event once the removable portion 54 of the unit 20 has been removed, the unit can be placed on the boot 10 as shown in FIGS. 6–8, whereupon the heel 18 of the boot 10 extends through the opening created by the removal of the removable portion 54, while the toe portion 12 of the boot is located within the toe box 26 as described earlier.

As should be appreciated by those skilled in the art the conversion of the unit 20 of this invention from its full-sole configuration to its half-sole configuration results in the creation of a relatively large opening from the forefoot region of the unit to the rear end of the heel region, i.e., the area encompassed by the original opening 38 and the portion of the heel which had been removed. Thus, the resulting half-sole unit can be used to accommodate various types and sizes of primary footwear which may not have been readily accommodated when the unit was in its full sole configuration, by virtue of the fact that the large opening can receive any size, type or shape of heel. This is particularly true since the device is formed of a resilient material and can readily stretch to further enhance footwear accommodation.

Without further elaboration the foregoing will so fully illustrate our invention that others may, by applying current or future knowledge, adapt the same for use under various conditions of service.

We claim:

1. A convertible, non-slip, attachment device for releasable mounting on a primary footwear, the primary footwear having a sole and an upper secured thereto, the upper having a toe portion and a heel counter portion, the sole having a toe portion, a contiguous forefoot portion, and a heel portion, said attachment device being formed of a stretchable severable material and comprising a sole, toe attachment means, heel attachment means, and visible indicia for indicating the boundary of a removable portion of said attachment device which may be severed therefrom, said sole of said device having a toe portion, a contiguous forefoot portion, a heel portion and a longitudinal axis extending along said sole, said toe attachment means projecting from said toe portion of said attachment device and adapted to be brought into engagement with the toe portion of the primary footwear for releasable securement thereto, said heel attachment means comprising an upstanding member projecting upward vertically from said sole at said heel portion of said attachment device on said longitudinal axis and having a top portion, and a pair of straps extending from said forefoot portion rearwardly and upwardly at an acute angle to said longitudinal axis and merging with said top portion of said upstanding member, said top portion of said upstanding member having a pull tab projecting upwardly therefrom to facilitate engagement of the upstanding member with the heel counter portion of the primary footwear for releasable securement thereto, said sole portion of said attachment device and said heel portion of said attachment device each including plural traction-enhancing projections, said heel portion of said attachment device including said indicia, said indicia comprising a line in the form of a severable groove and including portions extending along and in the same direction as said straps and a portion extending across said upstanding member, whereupon said removable portion of said attachment device can be severed from said attachment device along said groove to produce an opening through which the heel of the primary footwear may extend and to convert said attachment device from a full sole unit to a half-sole unit.

2. The attachment device of claim 1 wherein said attachment device is molded as a integral, sling-type unit from an resilient material.

3. The attachment device of claim 2 wherein said resilient material is selected from the group consisting of polyvinyl chloride and rubber.

4. The attachment device of claim 1 wherein said projections are formed of metal.

5. The attachment device of claim 1 wherein said toe attachment means comprises plural straps which merge together to form a toe box for receipt of the toe portion of the primary footwear.

6. The attachment device of claim 5 wherein said device has an pair of opposed sides and a longitudinal axis, and wherein said toe attachment means comprises first, second, and third straps, said first strap projecting from the toe portion of the attachment device in a direction generally parallel to said axis, said second and said third straps projecting from opposite sides of said device and merging with said first strap at a common junction.

7. The attachment device of claim 6 wherein said second and third straps project at an acute angle to said longitudinal axis.

8. The attachment device of claim 1 additionally comprising plural ridges on said pull tab to facilitate the gripping thereof.

9. A method of converting a full-sole, non-slip footwear attachment device into a half-sole, non-slip footwear attachment device for use on a primary footwear to render the primary footwear resistant to slippage on ice or snow, the primary footwear having a sole including a toe portion, a contiguous forefoot portion, and a heel portion, the full-sole, non-slip attachment device being formed of a severable material and comprising a sole having a longitudinal axis and heel attachment means, the heel attachment means comprising an upstanding member projecting upward vertically from the sole at the heel portion of the full-sole, non-slip attachment device on the longitudinal axis and a pair of straps, the upstanding member having a top portion, the pair of straps, extending from the forefoot portion rearwardly and upwardly at an acute angle to the longitudinal axis and merging with the top portion of the extending member, the top portion of the upstanding member having a pull tab projecting therefrom, the full-sole, non-slip attachment device having a removable portion which may be severed therefrom, the sole of the full-sole, non-slip attachment device also including a toe portion, a contiguous forefoot portion, a heel portion, and plural ice gripping projections in the forefoot and heel portions thereof, said method comprising:

(a) utilizing indicia in the form of a severable groove including portions extending along the straps and a portion extending across the upstanding member to define the boundary of the removable portion of the full-sole, non-slip attachment device, (b) severing the full-sole, non-slip footwear attachment device along the groove, and removing the removable portion to produce a heel-receiving opening in the sole thereof and thereby converting the full-sole, non-slip attachment device into the half-sole, non-slip footwear attachment device.

10. The method of claim 9 wherein after the removable portion of the full-sole, non-slip footwear attachment device is removed, the resulting half-sole, non-slip footwear attachment device is mounted on the primary footwear, with the forefoot portion of the sole of the half-sole, non-slip footwear attachment device in engagement with the forefoot portion of the sole of the primary footwear, and with the heel portion of the primary footwear extending through the heel-receiving opening in the sole of the half-sole, non-slip footwear attachment device.

11. A method of utilizing a non-slip footwear attachment device for use on a primary footwear to render the primary footwear resistant to slippage on ice or snow, the primary footwear having a sole including a toe portion, a contiguous forefoot portion, and a heel portion, the non-slip attachment device being formed of a severable material and comprising a sole having a longitudinal axis and heel attachment means, the heel attachment means comprising an upstanding member projecting upward vertically from the sole at the heel portion of the full-sole, non-slip attachment device on the longitudinal axis and a pair of straps, the upstanding member having a top portion, the pair of straps extending from the forefoot portion rearwardly and upwardly at an acute angle to the longitudinal axis and merging with the top portion of the upstanding member, the top portion of the upstanding member having a pull tab projecting therefrom, the full-sole, non-slip attachment device having a removable portion which may be severed therefrom to convert the attachment device from a full-sole, non-slip unit to a half-sole, non-slip unit, the sole of the attachment device also including a toe portion, a contiguous forefoot portion, a heel portion, and plural ice gripping projections in the forefoot and heel portions thereof, said method comprising:

(a) utilizing indicia in the form of a severable groove including portions extending along the straps and a portion extending across the upstanding member to define the boundary of the removable portion of the attachment device, (b) severing the attachment device along the groove to remove the removable portion thereof to produce a heel-receiving opening to thereby form the half-sole, non-slip unit and mounting the half-sole, non-slip unit on the primary footwear with the forefoot portion of the sole of the primary footwear in engagement with the forefoot portion of the sole of the half-sole, non-slip unit and with the heel portion of the primary footwear extending through the heel-receiving opening in the half-sole, non-slip unit, or (c) leaving the sole of the attachment device intact so as not to remove the removable portion, thereby maintaining the configuration of the attachment device as a full-sole, non-slip unit, and mounting the full-sole, non-slip unit on the primary footwear with the forefoot portion of the sole of the primary footwear in engagement with the forefoot portion of the sole of the full-sole, non-slip unit and with the heel portion of the primary footwear in engagement with the heel portion of the sole of the full-sole, non-slip unit.

* * * * *